US006170754B1

(12) United States Patent
Halford

(10) Patent No.: US 6,170,754 B1
(45) Date of Patent: Jan. 9, 2001

(54) SPIRAL RAMP FOR TOY VEHICLES

(75) Inventor: Wayne Halford, Hermosa Beach, CA (US)

(73) Assignee: Mattel, Inc., El Segundo ( * ) Notice: Under 35 U.S.C. 154(b), the term of this patent shall be extended for 0 days.

(21) Appl. No.: 09/021,615

(22) Filed: Feb. 10, 1998

(51) Int. Cl.[7] ..... E01B 23/00
(52) U.S. Cl. ..... 238/10 E; 104/56
(58) Field of Search ..... 238/10 A, 10 B, 238/10 E, 10 F; 104/53, 56, DIG. 1, 126, 125; 446/444

(56) References Cited

U.S. PATENT DOCUMENTS

| | | | | |
|---|---|---|---|---|
| 1,034,137 | * | 7/1912 | Muller | 104/56 |
| 1,039,545 | * | 9/1912 | Knight | 104/56 |
| 1,347,968 | * | 7/1920 | O'Doie | 104/56 |
| 3,299,565 | | 1/1967 | Yarashes . | |
| 3,480,210 | | 11/1969 | Perrinjaquet . | |
| 3,603,505 | | 9/1971 | Tsugawa . | |
| 3,653,626 | | 4/1972 | Tucker . | |
| 3,677,469 | | 7/1972 | Edmisson et al. . | |
| 3,703,989 | | 11/1972 | Tomiyama . | |
| 3,708,116 | | 1/1973 | Woodward . | |
| 3,712,538 | | 1/1973 | Starr et al. . | |
| 3,726,476 | | 4/1973 | Porter et al. . | |
| 3,735,923 | | 5/1973 | Brigham et al. . | |
| 4,052,067 | | 10/1977 | Carmo . | |
| 4,251,949 | | 2/1981 | Buck et al. . | |
| 4,285,157 | | 8/1981 | Lambert et al. . | |
| 4,516,953 | | 5/1985 | Hippely et al. . | |
| 4,585,166 | | 4/1986 | Stephens . | |
| 4,609,363 | | 9/1986 | Udagawa . | |
| 4,767,053 | | 8/1988 | Cook et al. . | |
| 5,678,489 | * | 10/1997 | Wang | 238/10 E |

* cited by examiner

*Primary Examiner*—S. Joseph Morano
*Assistant Examiner*—Robert J. McCarry, Jr.
(74) *Attorney, Agent, or Firm*—Roy A. Eskstrand

(57) ABSTRACT

A spiral ramp for toy vehicles includes a vertical center pole supported by a base having a receiving socket for the lower end of the pole and a plurality of radially extending feet. A plurality of support clamps are arranged at different positions along the center pole and receive the upper ends of a corresponding plurality of downwardly angled support arms. A plurality of curved track segments are serially joined to form a spiral ramp which is supported by the attachment of the lower ends of the support arms to selected ones of the curved track segments. The height and character of the spiral ramp thus formed is adjustable by moving the plurality of support clamps upon the center pole and adjusting the angle defined by the support arms extending therefrom.

5 Claims, 2 Drawing Sheets

10
11
12
13
14
15
16
17
18
20
21
22
23
24
25
26
27
28
29
30
31
32
33
34
35
40
41
42
43
44
60
61
62
63
64
65
66
67
68
70
71
72
73
74
84
85
86
87
89
90
91
92
2
2

11
41
21
36
31

SPIRAL RAMP FOR TOY VEHICLES

FIELD OF THE INVENTION

This invention relates generally to toy vehicle playsets and particularly to those utilizing free-wheeling vehicles operative within multiply curved and looped track sets.

BACKGROUND OF THE INVENTION

Toy vehicle playsets have become an extremely popular category of toy products and, notsurprisingly, this popularity has prompted practitioners in the art to create and fabricate a wide variety of toy vehicle playsets. Accordingly, vehicle playsets have been provided which employ a variety of track configurations which typically define multiple loops and curves and usually provide a smooth trackway having upwardly extending sidewalls for confining and guiding the toy vehicle. While many toy vehicle playsets utilize powered vehicles having small battery-powered motor drives in the toy vehicles, the more prevalent type of toy vehicle playset involves the use of a free-wheeling unpowered toy vehicle operative together with some type of apparatus for imparting energy and velocity to the toy vehicle. Typical types of devices used in accelerating such unpowered toy vehicles upon trackways have included elongated downwardly inclined gravity acceleration ramps, fixed launchers having a spring-driven type of accelerator which, in essence, "catapults" the toy vehicle onto the track as well as conventional rotating wheel booster accelerators which employ a pair of rotating soft foam wheels on each side of the toy vehicle track and which impart acceleration to the vehicle as it passes between the rotating wheels.

Regardless of the type of acceleration device used in such toy vehicle playsets, practitioners in the art have endeavored to provide more interesting and amusing trackways and trackway path devices for the toy vehicle to traverse. For example, U.S. Pat. No. 3,480,210 issued to Perrinjaquet sets forth a RACETRACK having an elongated flexible trackway defining a trackway path and rising sidewalls which is downwardly inclined from a table or other raised object to a floor surface and which is supported by a plurality of intermediate telescoping supports.

U.S. Pat. No. 3,677,469 issued to Edmisson, et al. sets forth a LOOPED TRACK SYSTEM FOR TOY WHEELED VEHICLES which provides a flexible trackway supported to produce a direction changing vertical loop. The direction changed is approximately ninety degrees in traversing the loop.

U.S. Pat. No. 3,703,989 issued to Tomiyama sets forth a TRACK DEVICE FOR TOY VEHICLE having a spiral track member defining inner and outer ends to which other track members may be joined to form a track assembly such as a continuous track. The spiral member is axially extensible and mounted upon a support adjacent the inner end of the spiral.

U.S. Pat. No. 3,708,116 issued to Woodward sets forth a CURVED ACCESSORY USABLE WITH TRACK SYSTEM FOR TOY WHEELED VEHICLES having a flexible trackway and a vertical support which includes a base having a raised support and a pair of lower supports. The trackway is secured to the lower supports on each side and is inverted and attached to the raised support to provide a loop which curves and inverts the toy vehicle.

U.S. Pat. No. 3,712,538 issued to Starr, et al. sets forth TOY VEHICLE TRACK SUPPORT STRUCTURE having a planar base defining a plurality of track attachment devices and a vertical tower. The vertical tower supports a horizontally extending arm having a track attachment at the end thereof. A flexible track passes over each side of the planar base and is secured thereto. The track further rises at its center and inverts forming an inverting loop, the high point of which is secured to the horizontal arm.

U.S. Pat. No. 3,726,476 issued to Porter, et al. sets forth a HELICAL TRACK SYSTEM having a helical ramp supported by a quartet of external support posts and having means at the upper and lower ends thereof for attaching to a trackway.

U.S. Pat. No. 3,735,923 issued to Brigham, et al. sets forth a LOOPED TRAFFIC ACCESSORY having a pair of support bases each secured to opposite ends of a vertical track loop. Each support base further includes an extending tongue for engaging and securing a straight line trackway to interpose the loop within a conventional trackway.

U.S. Pat. No. 4,585,166 issued to Stephens sets forth a COLLAPSIBLE TOY AUTOMOBILE RACE COURSE having a spiral track within an arrangement for biasing the track to act as a spring having a relaxed essentially collapsed position and an extended taut position. A post is provided for holding the track in an extended position so than one end is higher than the other forming a spiral.

U.S. Pat. No. 4,052,067 issued to Carmo sets forth a COMBINED BALL AND FLEXIBLE TRACK having an extended flexible track secured to supporting handles at each end thereof. A ball is rolled within the track between the two ends and opposing players raise and lower the track ends to roll the ball along the track.

U.S. Pat. No. 4,251,949 issued to Buck, et al. sets forth a TOY TRACK AND BOWL WITH CAR HEIGHT INDICATOR having a vertically disposed drum defining an entrance aperture coupled to a track ramp. A toy vehicle enters the drum at high speed and rapidly progresses about the drum.

U.S. Pat. No. 4,285,157 issued to Lambert sets forth a TOY RACING SET having at least one powered vehicle, a length of flexible track and a carrying case. The carrying unfolds to form a track upon which the vehicle may run. The case many be closed having the flexible track therein to provide a loop-the-loop track for a powered vehicle.

U.S. Pat. No. 4,516,953 issued to Hippely, et al. sets forth a TOY VEHICULAR PLAYSET having a horizontally disposed drum coupled to an entrance ramp and an exit ramp and defining a spiraling transitory path for toy vehicles therebetween.

U.S. Pat. No. 4,609,363 issued to Udagawa sets forth a TRACK TOY having a supporting tower replicating a robot and an encircling spiral track for toy vehicles.

U.S. Pat. No. 4,767,053 issued to Cook, et al. sets forth a MULTI-FUNCTION TOY STUNT SET which may be used to form a loop and ramps for use during play with toy vehicles. Two tower members with engaging grooves are mounted on top of a base and a frame with flexible sheet pieces is positioned between the tower members. A rod at the end of a flexible member may be inserted into grooves in order to form loops and ramps.

U.S. Pat. No. 3,299,565 issued to Yarashes; U.S. Pat. No. 3,653,626 issued to Tucker; and U.S. Pat. No. 3,603,505 issued to Tsugawa set forth various toy vehicle type accessories having looped trackways.

While the foregoing described prior art devices have provided improvement in the art and, in some instances enjoyed commercial success, there remains nonetheless a continuing need in the art for evermore improved interesting and entertaining toy vehicle playset accessories and devices.

SUMMARY OF THE INVENTION

Accordingly, it is a general object of the present invention to provide an improved accessory for use in a toy vehicle trackway playset. It is a more particular object of the present invention to provide an improved accessory for toy vehicle trackway playsets which provides a spiral ramp for use in the toy vehicle trackway.

In accordance with the present invention, there is provided for use in combination with a toy vehicle, a spiral ramp comprising: a center pole having a lower end and an upper end; a base for securing the lower end and supporting the center pole in a generally vertical orientation; a plurality of support clamps secured to the center pole between the lower end and the upper end in a generally spaced-apart arrangement each defining a first attachment means; a plurality of support arms each defining an upper end having a second attachment means cooperatively engaging one of the first attachment means and a lower end defining a third attachment means; and a plurality of curved track segments, at least some of the curved track segments defining a fourth attachment means each cooperatively engaging one of the third attachment means, the curved track segments being joined to form a spiral track supported by the support arms.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 5:
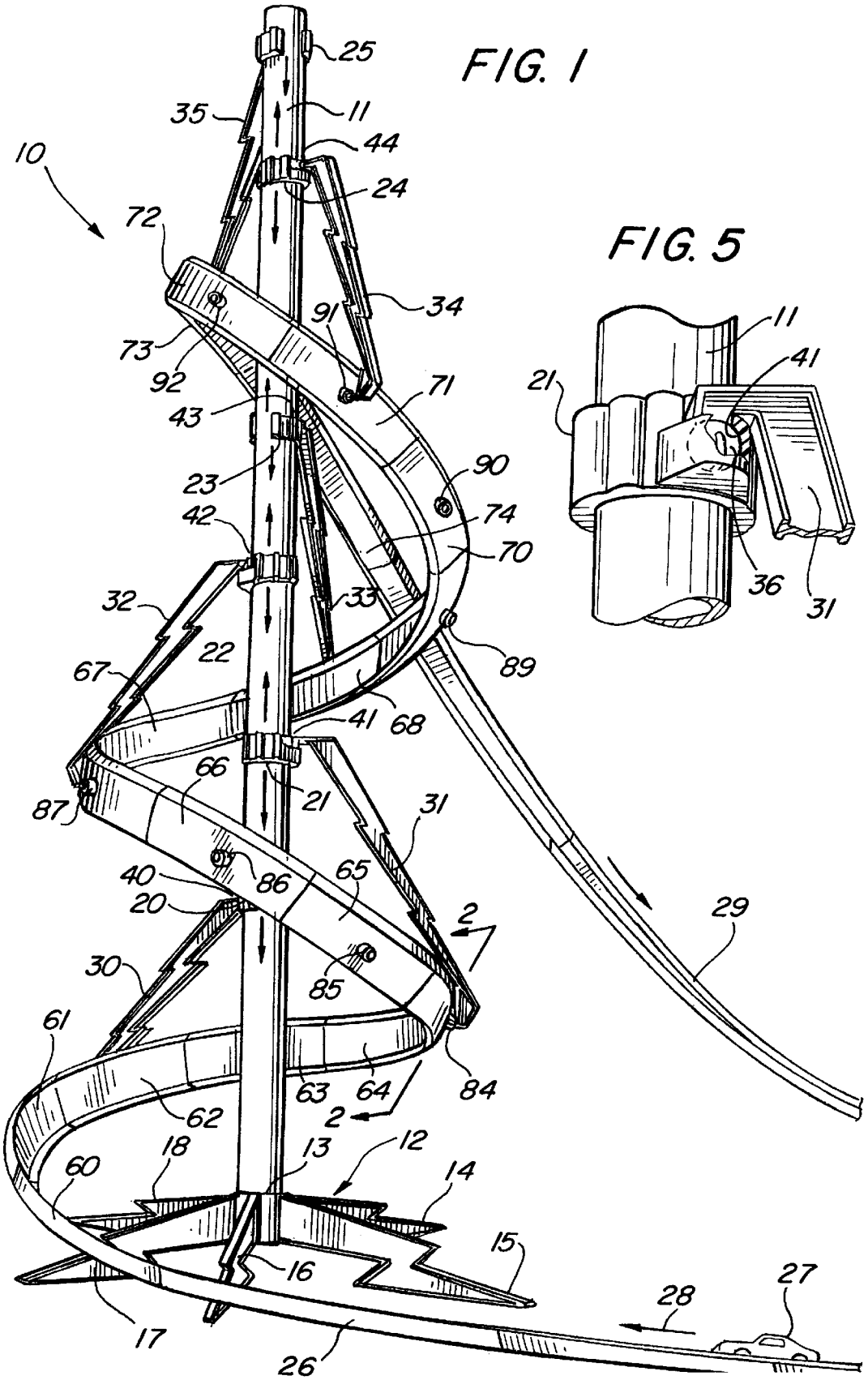
FIG. 1 sets forth a perspective view of a spiral ramp for toy vehicles constructed in accordance with the present invention.
FIG. 5 sets forth a partial section perspective view of the support clamp and support arm attachment of the present invention spiral ramp for toy vehicles.

FIG. 1 sets forth a perspective view of a spiral ramp for toy vehicles constructed in accordance with the present invention and generally referenced by numeral 10. Spiral ramp 10 includes a generally cylindrical center pole 11 having a bottom end received within a socket 13 defined in a support base 12. Base 12 further includes a plurality of radially extending feet 14 through 18 which are joined to socket 13 and extend outwardly to vertically support center pole 11. Spiral ramp 10 further includes a plurality of supports clamps 20, 21, 22, 23, 24 and 25, the structure of which is shown in FIG. 4 in greater detail. However, suffice it to note here that support clamps 20 through 25 are generally C-shaped in cross-section and are sufficiently resilient to be snap-fitted upon center pole 11. In the preferred fabrication of the present invention, support clamps 20 through 25 are spaced upon center pole 11 in the manner shown to provide an appropriate spacing for defining the spiral ramp of the curved trackway described below. In accordance with the present invention, support clamps 20 through 25 are vertically movable upon center pole 11 as indicated in either the upward or downward directions to adjust the eventual shape provided for the spiral ramp trackway. Support clamps 20 through 25 each define a respective arm socket 40 through 45, the structure of which is set forth below in FIG. 5. Suffice it to note here that each of support clamps 20 through 25 defines a spherical socket such as arm socket 41 shown in FIG. 5. Correspondingly, a plurality of support arms 30, 31, 32, 33, 34 and 35 are secured to support clamps 20 through 25 respectively by attachment to arm sockets 40 through 45 respectively. More specifically, support arms 30 through 35 each define a respective ball such as ball 36 shown in the upper portion of support arm 31 (shown in FIG. 5) which is received within arm sockets 40 through 45 respectively to secure the upper ends of support arms 30 through 35 to clamps 20 through 25. It will be understood that support clamps 20 through 25 are identical and further that support arms 30 through 35 are identical. Thus, the attachment of support arm 31 to support clamp 21 using arm socket 41 and ball 36 shown in FIG. 5 will be understood to be illustrative of the attachment of each of support arms 30 through 35 to support clamps 20 through 25. As is better seen in FIG. 3, each of support arms 30 through 35 define a respective ball member 50 through 55 at the lower ends thereof.

Spiral ramp 10 further includes an input track portion 26 and an exit track portion 29 operative to join spiral ramp 10 to the remainder of a toy vehicle trackway (not shown). For purposes of illustration, an illustrative free-wheeling unpowered toy vehicle 27 is shown traveling in the direction of arrow 28 upon track 26 in the anticipated use of the present invention spiral ramp. It will be understood, however, that the present invention spiral ramp is bilateral and thus while a climbing application is illustrated in FIG. 1, the present invention spiral ramp may be utilized within a toy vehicle track set in the opposite direction in which a toy vehicle enters the spiral via track section 29 and exits via track section 26 without departing from the spirit and scope of the present invention. In accordance with an important aspect of the present invention, the spiral trackway portion of spiral ramp 10 is fabricated of a plurality of curved interlocking trackway segments 60 through 74 which are sequentially coupled between track portion 26 and track portion 29. Curved track segments 60 through 74 are substantially identical and each define a respective cooperating interlock (not shown) which facilitates attachment of each track segment in a serial fashion to form a spiral track portion. This interlocking feature may utilize virtually any of the well known interlocks conventionally used in coupling toy vehicle trackway segments together. For example, track segments 60 through 74 may define respective male and female connector elements which form a continuous track by mating each male portion with the succeeding female portion of the sequential track segment forming the trackway.

Figure 2:
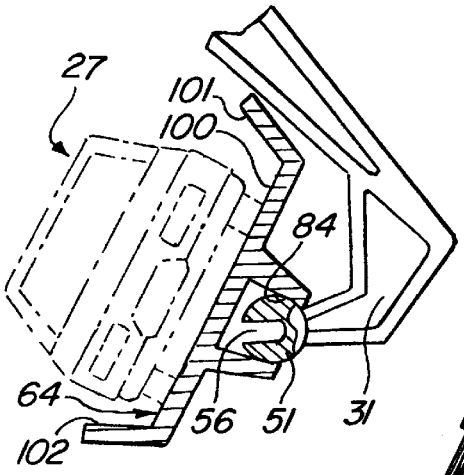
FIG. 2 sets forth a partial section view of the present invention spiral ramp taken along section lines 2—2 in FIG. 1.

In accordance with the present invention, each of curved track segments 60 through 74 define a respective ball socket on the underside thereof. Due to the perspective view of FIG. 1, ball socket 84 is visible on the bottom of track segment 64. FIG. 2 sets forth a section view of track segment 64 and ball segment 84 receiving ball 51 of arm support 31 in greater detail. However, suffice it to note here that ball socket 84 on the underside of curved track portion 64 facilitates the attachment of the lower end of support arm 31. Correspondingly, the perspective view of FIG. 1 also shows ball sockets 85, 86 and 87 on the underside of curved track segments 65, 66 and 67. In addition, the perspective view of FIG. 1 shows ball sockets 89, 90, 91 and 92 on the undersides of curved track segments 69, 70, 71 and 72 respectively. It will be understood, however, that while not seen in FIG. 1, the remainder of curved track segments within spiral ramp 10 also include identical ball sockets on the undersides thereof.

In accordance with an important aspect of the present invention, the spiral path of the trackway formed by curved segments 60 through 74 may be varied or adjusted by moving support clamps 20 through 25 and by separating one or more of the lower ends of support arms 30 through 35 from their coupled track segments and reattaching the lower ends of the support arms to different curved track segment ball sockets as desired. In this manner, the spiral path of the spiral ramp is varied to add further interest and enjoyment to the use of the present invention spiral ramp for toy vehicles.

FIG. 2 sets forth a partial section view of a typical track segment and support arm attachment taken along section lines 2—2 in FIG. 1. It will be understood that while FIG. 2 shows the specific structure for track segment 64 secured to support arm 31, the structure set forth in FIG. 2 is equally descriptive of the identical attachments between support arm 30 and its respective track segment (track segment 62 seen in FIG. 1) and support arms 32 through 35 and their respective attachments to track segments 67, 68, 71 and 73 (seen in FIG. 1).

More specifically, track segment 64 defines a trackway path 100 sufficiently planar to receive a toy vehicle such as toy vehicle 27 shown in dashed-line upon surface 100. Track segment 64 further defines a pair of upwardly extending sidewalls 101 and 102 which extend from trackway path 100. In addition, segment 64 defines a ball socket 84 on the underside of the track segment. Correspondingly, a support arm 31 defines a ball 51 having a slot 56 formed therein. Support arm 31 is joined to track segment 64 by forcing ball 51 into socket 84 thereof. During the insertion of ball 51 into socket 84, slot 56 allows ball 51 to deform sufficiently to be force inserted into socket 84. Thereafter, ball 51 expands to fill socket 84 and captivate ball 51 therein. It will be noted that the ball and socket attachment of arm 31 to track segment 64 facilitates a substantial degree of pivotal or angular adjustment between track segment 64 and support arm 31. Once again, it should be understood that the structure of track segment 64 is identical to track segments 61 through 63 and 65 through 74 and thus each track segment and its respective attachment to a support arm is accomplished in the identical fashion to that shown in FIG. 2 between track segment 64 and support arm 31. In the event it is desired to relocate support arm 31 in attachment to a different track segment to alter the spiral character of spiral ramp 10, a sufficient force applied to arm 31 against track segment 64 again deforms ball 51 and allows it to be withdrawn from socket 84.

Figure 3:
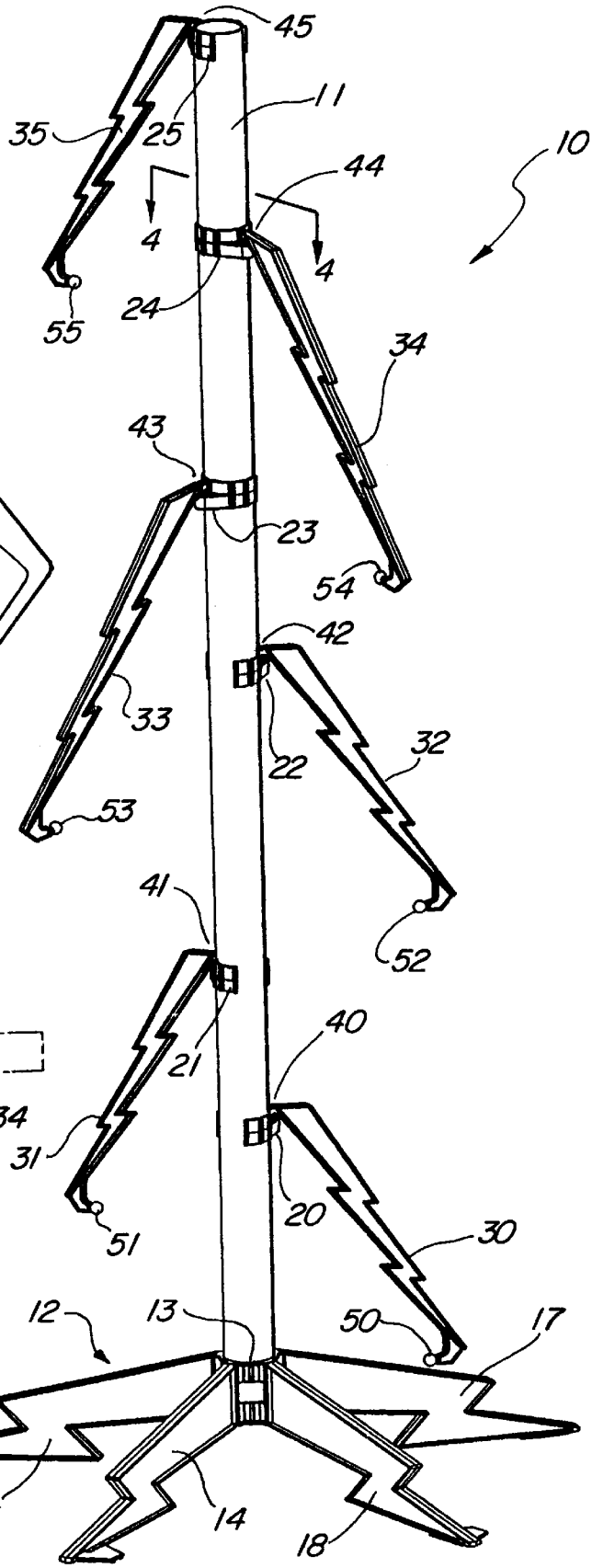
FIG. 3 sets forth a perspective view of the present invention spiral ramp for toy vehicles having the curved trackway ramp portions omitted.
Figure 4:
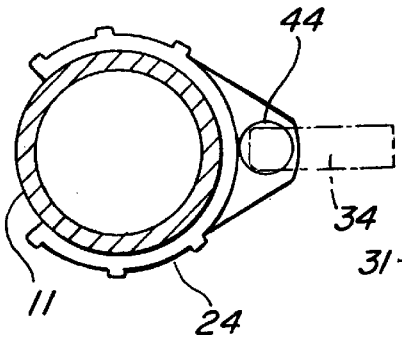
FIG. 4 sets forth a section view of the trackway support of FIG. 3 taken along section lines 4—4 therein.

To better illustrate the arrangement of support clamps and support arms upon center pole 11 of the present invention spiral ramp, FIG. 3 sets forth a perspective view of center pole 11 together with support clamps 20 through 25 and support arms 30 through 35 with the curved track segments and track portions 26 and 29 omitted. As described above, spiral ramp 10 includes a base 12 supported by a plurality of radially extending feet 14 through 18 (foot 16 not visible in FIG. 3 due to the perspective view). Base 12 further includes a socket 13 which receives the lower end of cylindrical pole 11. A plurality of support clamps 20 through 25 are snap-fitted upon pole 11 in the desired arrangement. Support clamps 20 through 25 define respective arm sockets 40 through 45 each configured as shown in FIG. 5 and each receiving the upper end of a support arm 30 through 35. Again, the attachment of the upper ends of support arms 30 through 35 is illustrated in FIG. 5 by the attachment of support arm 31 within arm socket 41 of support clamp 21. It will be apparent to those skilled in the art that the ball and socket attachment of the upper ends of support clamps 20 through 25 within arm sockets 40 through 45 allows for angular adjustment of support arms 30 through 35 upon center pole 11. This further facilitates the variability of the spiral ramp as clamps 20 through 25 are adjusted upon pole 11. FIG. 3 also shows the structure of balls 50 through 55 at the lower ends of support arms 30 through 35 respectively. It will be recalled from the above description of FIG. 2 that the attachment of each of support arms 30 through 35 is provided by inserting its respective ball within the ball socket of its associated curved track segment.

FIG. 4 sets forth a section view of pole 11, clamp 24 and arm 34 taken along lines 4—4 in FIG. 3. To facilitate the illustration of arm socket 44 of support clamp 24, support arm 34 is shown in dashed-line representation. More specifically, pole 11 defines a generally cylindrical cross-section and receives the generally C-shaped snap-fit attachment of clamp support 24. Clamp support 24 further supports an arm socket 44 within which support arm 34 is secured. It will be noted that clamp support 24 is preferably formed of a resilient material such as molded plastic or the like and is preferably sized to be snap-fit assembled to pole 11. Thus, clamp support 24 tightly grasps pole 11. However, the position of clamp support 24 may be adjusted upon pole 11 either rotationally or vertically by simply applying sufficient force to clamp 24 to cause it to slide or pivot upon pole 11.

FIG. 5 sets forth a partial section perspective view of the attachment of support arm 31 to clamp support 21. It will be recalled that support arms 30 through 35 are identical in structure and that their respective attachments to identical support clamps 20 through 25 respectively are fully illustrated by the structure and attachment shown in FIG. 5 for support clamp 21 and support arm 31. More specifically, pole 11 receives support clamp 21 in a snap-fit attachment in which support clamp 21 engages pole 11 with sufficient grasp to fix the position of clamp 21 upon pole 11. Support clamp 21 defines an arm socket 41 which receives ball 36 of support arm 31 in a snap-fit or force-fit insertion. The ball and socket attachment between ball 36 of arm 31 and arm socket 41 of clamp 21 allows the angular position of support arm 31 to be adjusted in order to accommodate the particular spiral shape assumed by the spiral ramp as illustrated in FIG. 10.

What has been shown is a spiral ramp for toy vehicles which provides an entertaining and amusing track portion within a toy vehicle trackway set. The spiral ramp described herein is capable of substantial adjustment both as to spiral height and spiral diameter and progression due to the novel clamp support attachment and ball and socket attachments between the support arms and their respective support clamps and track segments. The entire structure may readily be fabricated of relatively low cost molded plastic components and may be completely disassembled for compact storage between uses.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a toy vehicle, a spiral ramp comprising:

a center pole having a lower end and an upper end;

a base for securing said lower end and supporting said center pole in a generally vertical orientation;

a plurality of support clamps secured to and movable upon said center pole between said lower end and said upper end in a generally spaced-apart arrangement each defining a first attachment means;

a plurality of support arms each defining an upper end having a second attachment means cooperatively engaging one of said first attachment means and a lower end defining a third attachment means; and a plurality of curved track segments, at least some of said curved track segments defining a fourth attachment means each cooperatively engaging one of said third attachment means, said curved track segments being joined to form a spiral track supported by said support arms.

2. The spiral ramp set forth in claim 1 wherein said center pole is generally cylindrical and wherein said support clamps each include a generally C-shaped portion engaging said center pole.

3. The spiral ramp set forth in claim 2 wherein said first attachment means includes a first socket and wherein said second attachment means include a first ball insertable therein.

4. The spiral ramp set forth in claim 3 wherein said third attachment means include a second ball and wherein said fourth attachment means include a second socket receiving said second ball.

5. The spiral ramp set forth in claim 4 wherein each of said curved track segments define a fourth attachment means and wherein each of said third attachment means may be selectively joined to a selected one of said third attachment means to determine the spiral of said spiral track.

* * * * *